US009352204B2

(12) United States Patent
Gardner et al.

(10) Patent No.: US 9,352,204 B2
(45) Date of Patent: May 31, 2016

(54) PRACTICE HITTING TEE

(71) Applicant: Backspin Enterprises, Inc., Moore, OK (US)

(72) Inventors: Taylor M. Gardner, Moore, OK (US); Jarrett C. Gardner, Oklahoma City, OK (US)

(73) Assignee: Backspin Enterprises, Inc., Moore, OK (US)

( * ) Notice: Subject to any disclaimer, the term of this patent is extended or adjusted under 35 U.S.C. 154(b) by 0 days.

(21) Appl. No.: 14/726,013

(22) Filed: May 29, 2015

(65) Prior Publication Data

US 2015/0343289 A1 Dec. 3, 2015

Related U.S. Application Data

(60) Provisional application No. 62/005,521, filed on May 30, 2014.

(51) Int. Cl.
*A63B 69/00* (2006.01)

(52) U.S. Cl.
CPC ..... *A63B 69/0075* (2013.01); *A63B 2243/0004* (2013.01)

(58) Field of Classification Search
CPC ..... A63B 69/0073–69/0091; A63B 69/0002
USPC ..... 473/417–420, 430
See application file for complete search history.

(56) References Cited

U.S. PATENT DOCUMENTS 3,397,885 A 8/1968 Nash, Jr.
3,529,823 A * 9/1970 Garver ..... A63B 69/0075 273/DIG. 30
3,623,725 A * 11/1971 Setten, Sr. ..... A63B 69/0075 473/418
3,893,669 A * 7/1975 Myers ..... A63B 69/0079 273/DIG. 30
3,940,132 A * 2/1976 Lopatto, III ..... A63B 69/385 473/418
3,999,753 A * 12/1976 Desilets ..... A63B 69/0075 124/41.1
4,050,694 A 9/1977 Domroski
4,191,372 A 3/1980 Keller
5,282,615 A * 2/1994 Green ..... A63B 69/0079 473/418
5,713,805 A * 2/1998 Scher ..... A63B 69/0084 473/426
5,772,536 A * 6/1998 Wang ..... A63B 69/0075 473/417
6,334,821 B1 1/2002 Kita
6,358,163 B1 3/2002 Tanner
6,682,445 B1 1/2004 Tanner
6,790,150 B1 9/2004 Moss et al.
7,115,052 B2 10/2006 Wardle et al.
7,169,067 B2 * 1/2007 Town ..... A63B 69/0002 473/417
7,186,193 B1 3/2007 McFadden, Jr.
7,281,998 B2 10/2007 Tanner
8,033,934 B1 10/2011 Clancy (Continued)

*Primary Examiner* — Mark Graham
(74) *Attorney, Agent, or Firm* — Dunlap Codding, P.C.

(57) ABSTRACT

A practice hitting tee has a support structure and a ball holder. The support structure has a base end and a distal end. The ball holder has sidewall, a first end, and a second end. The ball holder may be formed of a flexible material and configured in a way that the second end has a ball receiving opening and the sidewall has at least one slit extending from the second end toward the first end. The ball holder is connected to the distal end of the support structure in a way that the second end of the ball holder extends downwardly away from the distal end of the support structure when the base end of the support structure is positioned on a horizontal support surface and frictionally grips a ball having a porous cover when at least a portion of the ball is positioned in the ball receiving opening.

19 Claims, 3 Drawing Sheets

(56) References Cited

U.S. PATENT DOCUMENTS

| | | | | |
|---|---|---|---|---|
| 8,585,516 | B1 | 11/2013 | Buono et al. | |
| 9,220,965 | B1 * | 12/2015 | Hochberg | A63B 69/0075 |
| 2005/0003908 | A1 * | 1/2005 | Smull | A63B 69/0002 473/419 |
| 2006/0019773 | A1 * | 1/2006 | Newman | A63B 69/0002 473/417 |
| 2009/0082140 | A1 * | 3/2009 | Liao | A63B 69/0002 473/417 |
| 2010/0009783 | A1 * | 1/2010 | Bozarth | A63B 69/385 473/419 |
| 2010/0304900 | A1 * | 12/2010 | Gu | A63B 69/0002 473/419 |
| 2011/0021294 | A1 * | 1/2011 | Tell | A63B 69/0002 473/417 |
| 2012/0165135 | A1 * | 6/2012 | Fischer | A63B 69/0002 473/417 |
| 2012/0172153 | A1 * | 7/2012 | Newman | A63B 69/0075 473/417 |
| 2013/0196793 | A1 * | 8/2013 | Murphy | A63B 69/0002 473/417 |
| 2013/0203527 | A1 * | 8/2013 | LoDuca | A63B 69/0075 473/418 |
| 2014/0315662 | A1 * | 10/2014 | Buono | A63B 69/0075 473/418 |
| 2015/0209644 | A1 * | 7/2015 | Verma | A63B 69/38 473/419 |

* cited by examiner

PRACTICE HITTING TEE

CROSS-REFERENCED TO RELATED APPLICATIONS

This application claims priority to U.S. Provisional Application Ser. No. 62/005,521 filed on May 30, 2014, the entire content of which is hereby expressly incorporated herein by reference.

BACKGROUND

Sports such as baseball and softball involve hitting a ball with a bat. Being proficient at hitting a baseball and a softball requires practice. Many different types of training devices have been developed over the years to help players become more skilled at hitting. The most common practice device presently used for hitting practice is a hitting tee of the type that has a stationary stand on which the baseball or softball sits. The height of the hitting tee, and thus the ball when it is on the hitting tee, is usually adjustable.

While this type of hitting tee is generally easy to use and enables the hitter to hit balls that are unaltered, it has several drawbacks. For example, because the ball is resting on top of the tee, a hitter necessarily must hit the tee when hitting the bottom half of the ball, which is required to obtain an upward ball trajectory. To avoid striking the tee, the hitter may have a tendency to hit less desirable areas of the ball, such as the middle or upper half of the ball, thereby engraining bad swing habits.

Some other training devices for hitting include a ball suspended from a tether. In most instances, the ball is fixed to the tether in a way that the ball remains attached to the tether after the ball is hit. As such, the hitter is at risk of being hit by the ball as it swings around the support structure. In addition, the hitter is unable to determine if the ball was struck properly because the hitter is unable to observe the flight of the ball.

Attempts have been made to create practice hitting tee that overcomes the problems discussed above. For example, practice hitting devices have been suggested that include a ball removably secured to the end of a structure or line from which it is suspended. The ball releases from the line when the user strikes the ball with enough force to break the elements holding the ball in place. However, with such devices, the ball is required to be altered relative to regulation balls in way that allows the ball to be releaseably attached to the tether. By requiring an altered ball, the hitter again does not get realistic feedback on the flight of a type of ball that will be used in a game situation. Moreover, a hitter will be required to purchase a significant number of the altered balls to practice efficiently and effectively.

In another example, U.S. Publication No. 2009/0082140 discloses a batting apparatus that employs a suction cup suspended from a tether. The suction cup is configured such that it only temporarily supports a baseball or softball due to the porous nature of the covers of baseballs and softballs. As such, a hitter must quickly ready himself to strike the ball after attaching the suction cup to the ball. In addition, the hitter must face the risk of injury due to the tether spinning around the support structure. Alternatively, the hitter can wait until the ball drops from the suction cup. In the case of the latter, the ball is moving downwardly and is not covered in any way that would train a hitter to strike preferred areas of the ball.

To this end, a need exists for practice hitting tee that allows a hitter to practice hitting an unaltered ball with a bat in a way that the practice hitting tee safely encourages a batter to strike the bottom half of the bottom while providing realistic feedback to the hitter. It is to such a practice hitting tee that the inventive concepts disclosed herein are directed.

DETAILED DESCRIPTION OF EXEMPLARY EMBODIMENTS

Figure 1:
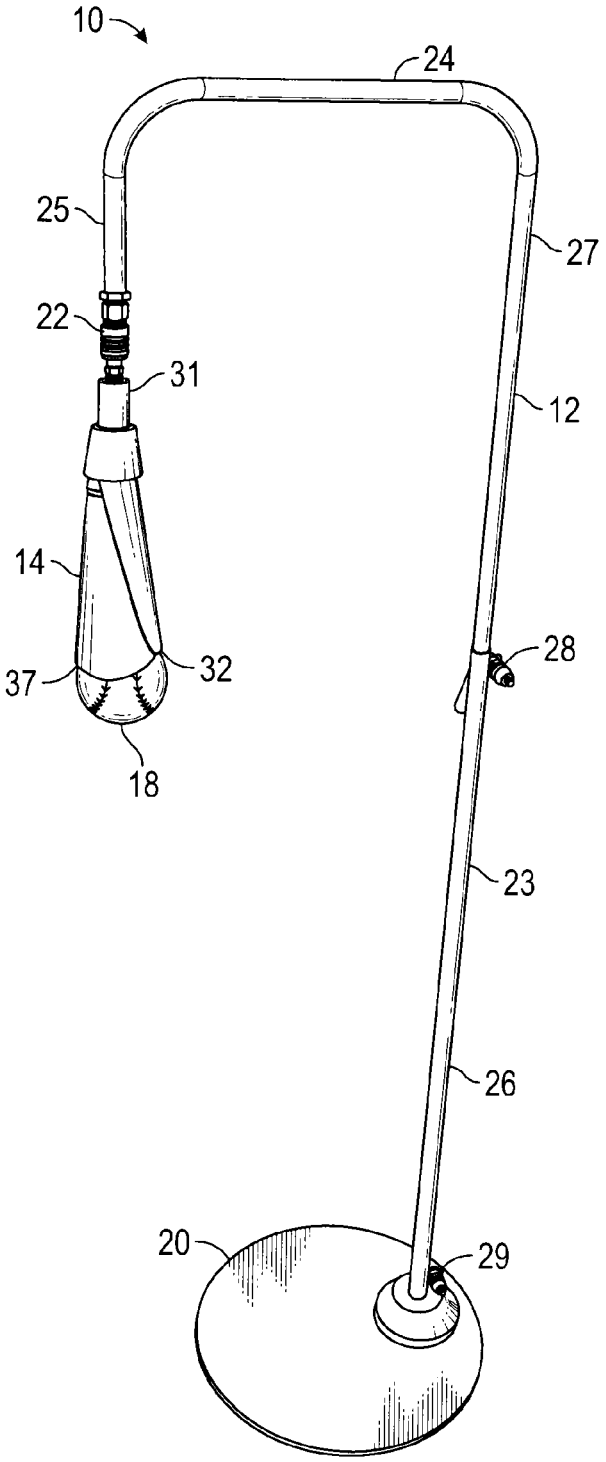
FIG. 1 is a perspective view of a practice hitting tee constructed in accordance with the inventive concepts disclosed herein shown with a baseball supported thereby.

Before explaining at least one embodiment of the inventive concepts in detail, it is to be understood that the inventive concepts disclosed herein are not limited in its application to the details of construction, experiments, exemplary data, and the arrangement of the components set forth in the following description or illustrated in the drawings. The inventive concepts are capable of other embodiments or being practiced or carried out in various ways. Also, it is to be understood that the phraseology and terminology employed herein is for purposes of description and should not be regarded as limiting.

In the following detailed description of embodiments of the inventive concepts, numerous specific details are set forth in order to provide a more thorough understanding of the inventive concepts. However, it will be apparent to one of ordinary skill in the art that the inventive concepts within the disclosure may be practiced without these specific details. In other instances, certain well-known features may not be described in detail to avoid unnecessarily complicating the instant disclosure.

As used herein, the terms "comprises," "comprising," "includes," "including," "has," "having," or any other variation thereof, are intended to cover a non-exclusive inclusion. For example, a process, method, article, or apparatus that comprises a list of elements is not necessarily limited to only those elements but may include other elements not expressly listed or inherently present therein.

Unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

The term "and combinations thereof" as used herein refers to all permutations or combinations of the listed items preceding the term. For example, "A, B, C, and combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AAB, BBC, AAABCCCC, CBBAAA, CABABB, and so forth. A person of ordinary skill in the art will understand that typically there is no limit on the number of items or terms in any combination, unless otherwise apparent from the context.

In addition, use of the "a" or "an" are employed to describe elements and components of the embodiments herein. This is done merely for convenience and to give a general sense of the inventive concepts. This description should be read to include one or at least one and the singular also includes the plural unless it is obvious that it is meant otherwise.

The use of the terms "at least one" and "one or more" will be understood to include one as well as any quantity more than one, including but not limited to each of,2, 3, 4, 5, 10, 15, 20, 30, 40, 50, 100, and all integers and fractions, if applicable, therebetween. The terms "at least one" and "one or more" may extend up to 100 or 1000 or more, depending on the term to which it is attached; in addition, the quantities of 100/1000 are not to be considered limiting, as higher limits may also produce satisfactory results.

Further, as used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

As used herein qualifiers such as "about," "approximately," and "substantially" are intended to signify that the item being qualified is not limited to the exact value specified, but includes some slight variations or deviations therefrom, caused by measuring error, manufacturing tolerances, stress exerted on various parts, wear and tear, and combinations thereof, for example.

Figure 2:
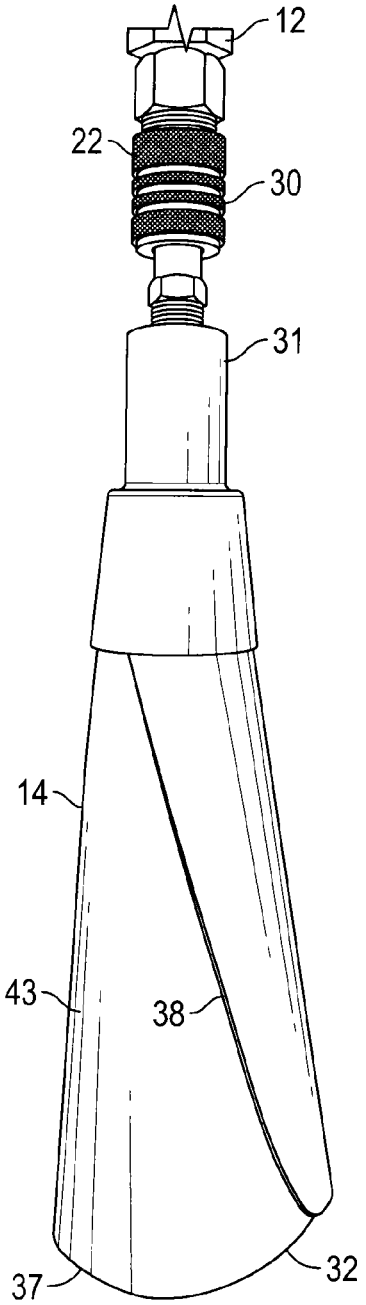
FIG. 2 is an enlarged perspective view of a ball holder of the practice hitting tee of FIG. 1.

Referring now to the drawings, and in particular to FIGS. 1 and 2, shown therein is an exemplary embodiment of a practice hitting tee 10 constructed in accordance with the inventive concepts disclosed herein. Broadly, the practice hitting tee 10 includes a support structure 12 and a ball holder 14 suspended from the support structure 12. The ball holder 14 frictionally grips a ball 18, such as a baseball or softball having a porous cover, when at least a portion of the ball 18 is positioned in a ball receiving opening of the ball holder 14.

In one embodiment, the support structure 12 may include a base end 20, a distal end 22, and have a generally inverted J-shape when the base end 20 is positioned on a horizontal support surface. The support structure 12 may include a first portion 23 extending upwardly from the base end 20, a second portion 24 extending horizontally from the first portion 23, and a third portion 25 extending downwardly from second portion 24 a distance from the first portion 23. The first support portion 23 may be one piece or include plurality of telescoped sections, such as a first telescoping section 26 and a second telescoping section 27 to permit the position of the distal end 22 of the support structure 12 relative to the base end 20 to be selectively adjusted. The first and second telescoping sections 26 and 27 may be releasably secured relative to one another in any suitable manner, such as with a latch 28.

The first portion 23, the second portion 24, and the third portion 25 of the support structure 12 may be formed in a variety of shapes and may be made from a variety of materials including, but not limited to, metal, plastic or a combination thereof, so that the support structure 12 is rigid, impact resistant, light weight, and corrosive resistant. Also, while the first support portion 23, the second support portion 24, and the third portion 25 are shown as being cylindrical in shape, it is understood that the first support portion 23, the second support portion 24, and the third portion 25 may be made of a variety of other shapes or configurations including but not limited to square, oval and rectangular.

The base end 20 is positioned at a lower end the support structure 12 to provide stability to the practice hitting tee 10 and thus to prevent the practice hitting tee 10 from tipping over when in use. In one embodiment, the base end 20 may be a weighted member releasably connected to the first portion 23 with a latch 29. However, it should be appreciated that the base end 20 may be in many different forms so long as the base end 20 provides stability to the practice hitting tee 10. For example, the base portion 20 may be an H-shaped structure or a structure with a cavity to permit the base end 20 to be weighted with sand or water. Also, the base end 20 may include a plurality of legs to form a stand, similar to a tripod. In another embodiment, the base end 20 may be in the form of a spike that may be inserted into the ground support.

The distal end 22 may include a suitable connector member, such as a coupler 30, for connecting the ball holder 14 to the support structure 12 in a manner to be discussed below.

The ball holder 14 has a sidewall 43, a first end 31, and a second end 32. The ball holder 14 includes a sheet of flexible material 36 rolled into a frusto-conical shape that forms a ball receiving opening 37 at the second end 32. The ball holder 14 tapers from the second end 32 toward the first end 31. In one embodiment, overlapping portions of the sheet of material 36 form a slit 38 extending from the second end 32 toward the first end 32. The slit 38 provides relief to allow the ball receiving opening 37 to expand and contract as necessary to frictionally grip a ball having a porous cover, such as the ball 18, when at least a portion of the ball 18 is positioned in the ball receiving opening 37. The ball holder 14 is connected to the distal end 22 of the support structure 12 in a way that the second end 32 of the ball holder 14 extends downwardly away from the distal end 22 of the support structure 12 when the base end 20 is supported on a horizontal support surface, such as the ground or a floor.

Figure 3:
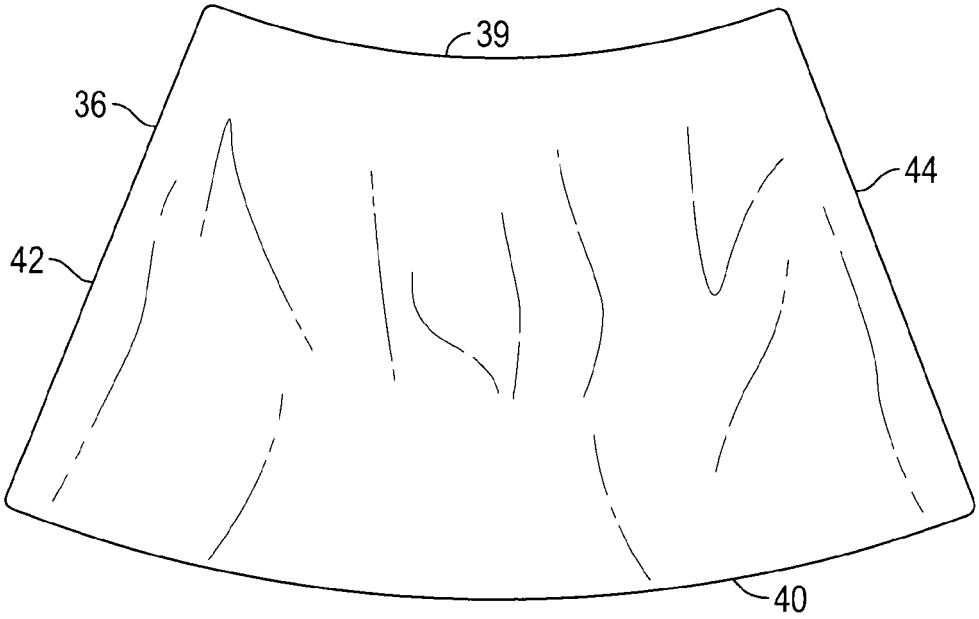
FIG. 3 is a plan view of a sheet of material used for constructing the ball holder of FIGS. 1 and 2.

The sheet of material 36 may be made from any suitable material that is capable of frictionally gripping a ball having a porous cover. In one embodiment, the sheet of material 36 may be made of a rubber or polymeric material, such as polypropylene, polyethylene or polyvinyl chloride, fabric, or some other suitable material or combination of materials. FIG. 3 depicts the sheet of material 36 in a flattened state from which the ball holder 14 may be fashioned. The sheet of material 36 is characterized as having a first end 39, a second end 40, a first side 42, and a second side 44 and may be generally trapezoidal in shape.

In choosing a suitable material for the ball holder, attention should be given to the flexibility and rigidity of the material. When rolled to form the ball holder 14, the material may exhibit sufficient rigidity to grip a baseball or softball and to return to its frusto-conical shape after being hit with a bat, yet be sufficiently collapsible to give way when struck by a bat. Too much rigidity in the ball holder 14 may cause the hitting tee 10 to topple when the ball holder 14 is struck by a bat.

The sheet of material 36 may be constructed of a single layer of material or a plurality of layers of the same or different types of materials. When the sheet of material 36 is constructed of a plurality of layers of material, the layers of material comprising the sheet of material 36 may be connected together such as by lamination or may be separate layers.

The sheet of material 36 may be opaque to obscure an upper portion of a ball (e.g., upper one-third to upper one-half) from view when the ball 18 is positioned in the ball receiving opening 37 of the ball holder 14. Also, the sheet of material 36 may vary in color. In one version, the sheet of material 36 may be a color in contrast to the color of the baseball or softball (e.g., black or gray). Further, the sheet of material 36 may consist of designs, or logos, advertisement, or decorative patterns, which are printed, etched, and/or embossed thereon using inks or other printing materials.

In one embodiment for use with a baseball, the ball holder 14 may be constructed of a sheet of material having a height of about 8 inches, a minor width corresponding with the first end 31 of the ball holder 14 of about 6 inches, and a major width corresponding with the second end 32 of the ball holder 14 of about 10 inches. In an embodiment for use with a softball, the ball holder 14 may be constructed on a sheet of material having a height of about 9 inches, a minor width corresponding with the first end 30 of the ball holder 14 of about 7 inches, and a major width corresponding with the second end 32 of about 13 inches.

In use, a ball, such as the ball 18, is positioned in the ball receiving opening 37 of the ball holder 14, as illustrated in FIGS. 1 and 2, so that the ball 18 is frictionally gripped by the ball holder 14 and an upper portion of the ball 18 is hidden from view in a way that a lower portion of the ball 18 is predominantly visible to the hitter. The hitter then strikes the ball 18 with a bat. Because the lower portion of the ball 18 is predominantly visible, the hitter is encouraged to strike the lower portion of the ball 18 in a way that causes the ball 18 to travel with an upward trajectory. At the same time, the flexibility of the ball holder 14 provides little resistance to the ball 18, thereby providing the hitter with real feedback as to how the ball was struck.

Figure 4:
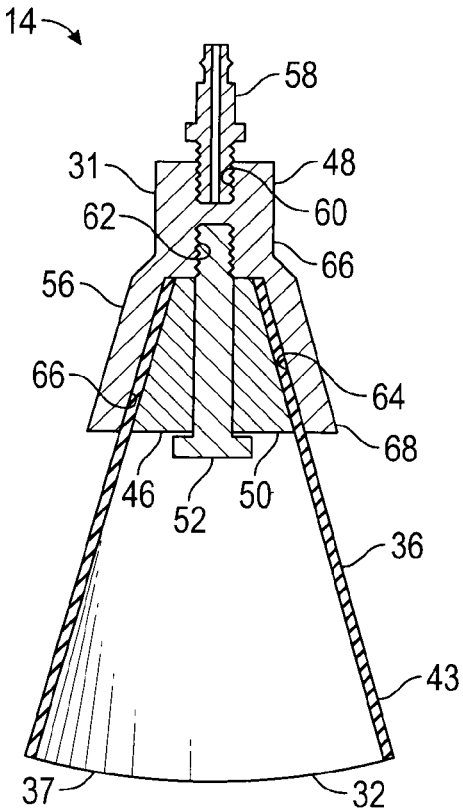
FIG. 4 is a cross sectional view of the ball holder of FIGS. 1 and 2.

Referring now to FIG. 4, the sheet of material 36 may be wrapped about a fastener 46 and secured thereto with a connecter 48. The fastener 46 may include a clamp member 50 and a securing member 52 which may pass through an opening of the clamp member 50 for securing the fastener 46 to the connector 48. The connector 48 may include a base 56 and a male plug 58 configured to be connected to the coupler 30 of the third support portion 25 in a way that allows the ball holder 14 to rotate relative to the support structure 12 about a longitudinal axis of the ball holder 14.

The base 56 may have a first threaded opening 60 configured to receive the male plug 58 of the connector 48 and a second threaded opening 62 configured to receive the securing member 52 of the fastener 46. An inner surface 64 of the base 56 defines a cavity 66 configured to receive an upper portion of the clamp member 50. The base 56 has a proximal end 68 and a distal end 70 with the inner surface 64 of the base flaring from the proximal end 66 to the distal end 68 in a way that forms the frusto-conical shape of the ball holder 14. The shape of the clamp member 50 corresponds to the shape of the inner surface 64 of the base 56 such that the sheet of material 36 wrapped about the connecter 48 may rest substantially flush against the inner surface 64 of the base 56.

The sheet of material 36 and the clamp member 50 of fastener 46 may be sized such that the sheet of material 36 may be wrapped about the clamp member 50 about one and one-half times. By way of example, an upper portion of the clamp member 50 may have a diameter of about 1 inch for use with baseballs and 1¼ inch for use with softballs.

Figure 5:
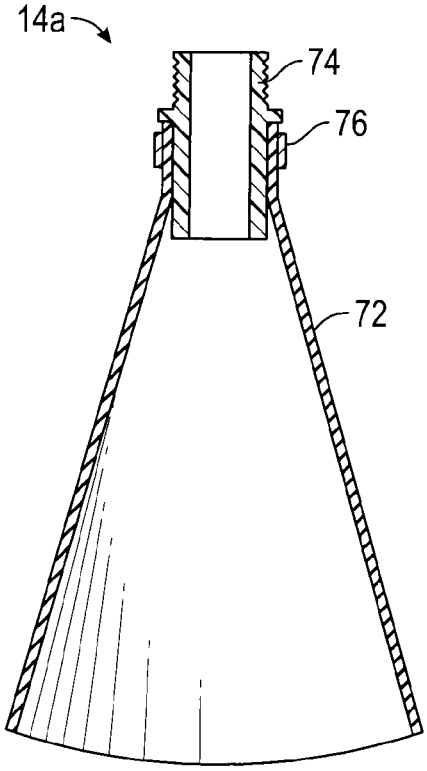
FIG. 5 is a cross sectional view of another embodiment of a ball holder constructed in accordance with the inventive concepts disclosed herein.

Referring now to FIG. 5, another embodiment of a ball holder, such as ball holder 14*a*, is shown. A sheet of material, such as sheet of material 72 may wrapped about a connector 74 and secured thereto with a fastener 76, such as a clamp. The connector 74 may be a threaded fitting configured to be connected to a fitting (not shown) of the third support portion 25 to rigidly connect the ball holder 14 to the support structure 12 in a way that prevents the ball holder 14 from rotating or swinging about the support structure 12. The sheet of material 72 and the connector 74 may be sized such that the sheet of material 72 may be wrapped about the connector 74 about one and one-half times. By way of example, the connector 74 may have a diameter of about 1 inch for use with baseballs and 1¼ inch for use with softballs.

In FIG. 5, the sheet of material 72 is shown to be held in a rolled, frusto-conical shape by the connector 74 and the fastener 76 so as to form the ball holder 14*a*.

Figure 6:
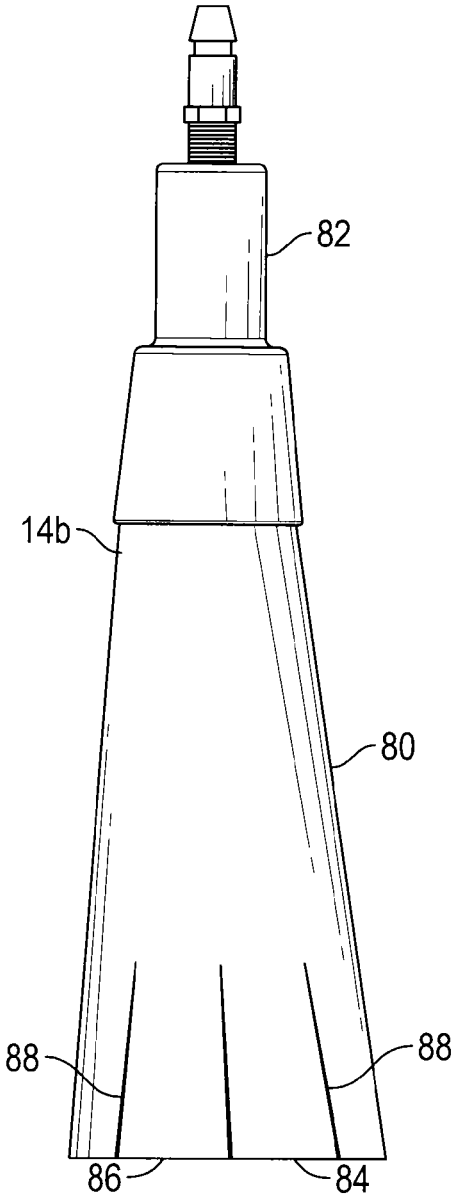
FIG. 6 is an elevational view of another embodiment of a ball holder constructed in accordance with the inventive concepts disclosed herein.

FIG. 6 illustrates another embodiment of a ball holder 14*b*. The ball holder 14*b* has a sidewall 80, a first end 82, and a second end 84. The ball holder 14*b* is formed of a flexible material and configured to have a conical or frusto-conical shape with the second end 84 having a ball receiving opening 86. The sidewall 80 may be formed by rolling a sheet of material in a manner similar to that described above, or the sidewall 80 may molded or extruded to the desired shape. The sidewall 80 has at least one slit 88 extending from the second end 84 toward the first end 82. In one embodiment, the sidewall 80 may have a plurality of slits 88 spaced about the sidewall 80. The slits 88 provides relief to allow the ball receiving opening 86 to expand and contract as necessary to frictionally grip a ball, such as the ball 18, when at least a portion of the ball 18 is positioned in the ball receiving opening 86.

Figure 7:
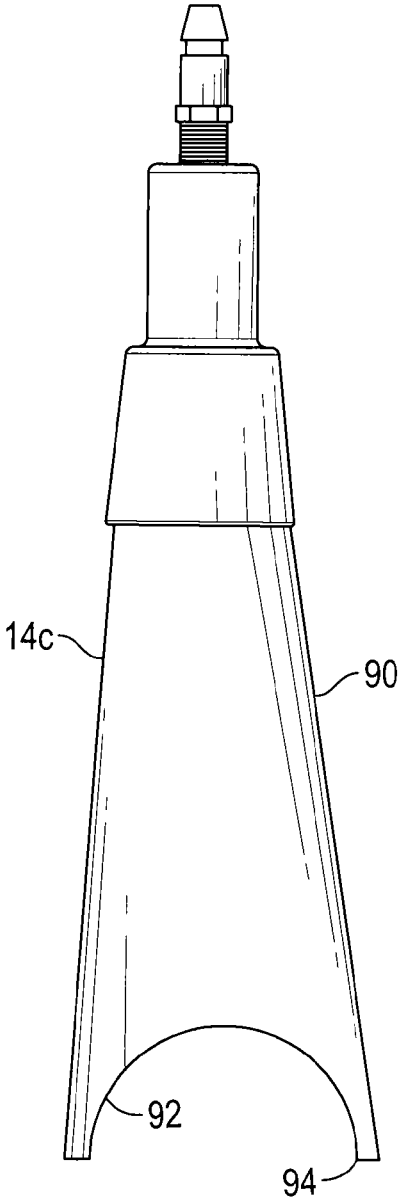
FIG. 7 is an elevational view of another embodiment of a ball holder constructed in accordance with the inventive concepts disclosed herein.

FIG. 7 illustrates an embodiment of a ball holder 14*c* similar to the ball holder 14*b*, except a sidewall 90 of the ball holder 14*c* is formed with two opposing slits or slots 92. The slits 92 may be formed in a variety of shapes and sizes. In one embodiment, the slits 92 are configured to substantially conform to the contour of a ball to facilitate the passage of the ball from a ball receiving opening 94 upon being struck by a bat.

From the above description, it is clear that the inventive concepts disclosed and claimed herein are well adapted to carry out the objects and to attain the advantages mentioned herein, as well as those inherent in the invention. While exemplary embodiments of the inventive concepts have been described for purposes of this disclosure, it will be understood that numerous changes may be made which will readily suggest themselves to those skilled in the art and which are accomplished within the spirit of the inventive concepts disclosed and/or defined in the appended claims.

What is claimed is:

1. A practice hitting tee, comprising:

a support structure having a base end and a distal end; and a ball holder having sidewall, a first end, and a second end opposite the first end, the ball holder formed of a flexible material and configured in a way that the second end has a ball receiving opening and the sidewall has at least one slit extending from the second end toward the first end, the ball holder connected to the distal end of the support structure in a way that the second end of the ball holder extends downwardly away from the distal end of the support structure when the base end of the support structure is positioned on a horizontal support surface, wherein the ball holder frictionally grips a ball having a porous cover when at least a portion of the ball is positioned in the ball receiving opening.

2. The practice hitting tee of claim 1, wherein the ball holder includes a sheet of flexible material rolled to define the sidewall with overlapping portions forming the slit.

3. The practice hitting tee of claim 1, wherein first end of the ball holder is rigidly connected to the distal end of the support structure.

4. The practice hitting tee of claim 3, wherein the ball holder has a longitudinal axis extending from the first end to the second end, and wherein the ball holder is rotatable relative to the support structure about the longitudinal axis of the ball holder.

5. The practice hitting tee of claim 1, wherein the flexible material is opaque so as to obscure an upper portion of the ball from view when the ball is positioned in the ball receiving opening of the ball holder.

6. The practice hitting tee of claim 1, wherein the support structure has a generally inverted J-shape when the base end is positioned on a horizontal support surface.

7. The practice hitting tee of claim 6, wherein the support structure is rigid between base end and the distal end.

8. The practice hitting tee of claim 6, wherein the support structure includes a plurality of telescoping sections.

9. A practice hitting tee in combination with a ball having a porous cover, the practice hitting tee comprising:

a support structure having a base end and a distal end; and a ball holder having sidewall, a first end, and a second end opposite the first end, the ball holder formed of a flexible material and configured in a way that the second end has a ball receiving opening and the sidewall has at least one slit extending from the second end toward the first end, the ball holder connected to the distal end of the support structure in a way that the second end of the ball holder extends downwardly away from the distal end of the support structure when the base end of the support structure is positioned on a horizontal support surface, wherein the ball is frictionally gripped by the ball holder with a portion of the ball extending downwardly from the ball holder.

10. The combination of claim 9, wherein the ball holder includes a sheet of flexible material rolled to define the sidewall with overlapping portions forming the slit.

11. The combination of claim 9, wherein first end of the ball holder is rigidly connected to the distal end of the support structure.

12. The combination of claim 11, wherein the ball holder has a longitudinal axis extending from the first end to the second end, and wherein the ball holder is rotatable relative to the support structure about the longitudinal axis of the ball holder.

13. The combination of claim 9, wherein the flexible material is opaque so as to obscure an upper portion of the ball from view.

14. The combination of claim 9, wherein the support structure has a generally inverted J-shape when the base end is positioned on a horizontal support surface.

15. The combination of claim 14, wherein the support structure is rigid between base end and the distal end.

16. The combination of claim 14, wherein the support structure includes a plurality of telescoping sections.

17. A method of supporting a ball, comprising:

obtaining a ball holder having sidewall, a first end, and a second end opposite the first end, the ball holder formed of a flexible material and configured in a way that the second end has a ball receiving opening and the sidewall has at least one slit extending from the second end toward the first end;

supporting the ball holder in a way that the second end of the ball holder extends downwardly away from the first end; and positioning the ball into the ball receiving opening so that the ball is frictionally gripped by the ball holder with a portion of the ball extending downwardly from the ball holder.

18. The method of claim 17, further comprising obscuring an upper portion of the ball from view.

19. The method of claim 17, wherein the step of supporting the ball holder further comprises:

positioning a support structure on a horizontal support surface, the support structure having a base end and a distal end; and connecting the first end of the ball holder to the distal end of the support structure.

* * * * *